US010640287B2

(12) United States Patent
Su et al.

(10) Patent No.: US 10,640,287 B2
(45) Date of Patent: May 5, 2020

(54) CONNECTING MECHANISM AND COLLAPSIBLE CONTAINER COMPRISING THE SAME

(71) Applicants: DALIAN CIMC SPECIAL LOGISTICS EQUIPMENTS CO., LTD., Liaoning (CN); CHINA INTERNATIONAL MARINE CONTAINERS (GROUP) LTD., Guangdong (CN); CIMC CONTAINERS HOLDING COMPANY LTD., Guangdong (CN); DALIAN CIMC LOGISTICS EQUIPMENT CO., LTD., Liaoning (CN)

(72) Inventors: Jijun Su, Liaoning (CN); Chunliang Liu, Liaoning (CN)

(73) Assignees: DALIAN CIMC SPECIAL LOGISTICS EQUIPMENTS CO., LTD., Liaoning (CN); CHINA INTERNATIONAL MARINE CONTAINERS (GROUP) LTD., Guangdong (CN); CIMC CONTAINERS HOLDING COMPANY LTD., Guangdong (CN); DALIAN CIMC LOGISTICS EQUIPMENT CO., LTD., Liaoning (CN)

( * ) Notice: Subject to any disclaimer, the term of this patent is extended or adjusted under 35 U.S.C. 154(b) by 344 days.

(21) Appl. No.: 15/526,701

(22) PCT Filed: Jul. 6, 2015

(86) PCT No.: PCT/CN2015/083396
§ 371 (c)(1),
(2) Date: May 12, 2017

(87) PCT Pub. No.: WO2016/074490
PCT Pub. Date: May 19, 2016

(65) Prior Publication Data

US 2017/0305658 A1 Oct. 26, 2017

(30) Foreign Application Priority Data

Nov. 13, 2014 (CN) ..... 2014 1 0640576

(51) Int. Cl.
*B65D 88/00* (2006.01)
*B65D 90/00* (2006.01)
(Continued)

(52) U.S. Cl.
CPC ..... *B65D 90/0006* (2013.01); *B65D 88/022* (2013.01); *B65D 88/522* (2013.01); *B65D 88/524* (2013.01); *B65D 90/0026* (2013.01)

(58) Field of Classification Search
CPC ..... B65D 90/0006; B65D 90/0026; B65D 88/22; B65D 88/522; B65D 88/524; B65D 88/121; B65D 21/086
(Continued)

(56) References Cited

U.S. PATENT DOCUMENTS 4,388,995 A 6/1983 Ahn
4,848,618 A * 7/1989 Yuan ..... B65D 88/524 220/1.5
(Continued)

FOREIGN PATENT DOCUMENTS

CN 2761544 Y 3/2006
CN 201010261 Y 1/2008
(Continued)

OTHER PUBLICATIONS

Innovation, Sciences and Economic Development Canada—Canadian Intellectual Property Office, Examination Search Report, dated Mar. 28, 2018, 4 pages.
(Continued)

*Primary Examiner* — Elizabeth J Volz

(57) ABSTRACT

A connecting mechanism is used for a collapsible container, the collapsible container comprises a top cover and a chassis, four corners of the top cover are provided with a top corner piece which is connected with a top cover corner pillar, and four corners of the chassis are provided with a bottom corner piece which is connected with a chassis corner pillar, the connecting mechanism comprises a crook lug located at one of the top cover corner pillar and the chassis corner pillar; and a crook locking plate rotatablely provided at the outer end face of the other of the top cover (Continued)

corner pillar and the chassis corner pillar, the crook locking plate is provided with a crook part cooperating with the crook lug.

19 Claims, 12 Drawing Sheets

(51) Int. Cl.
*B65D 88/52* (2006.01)
*B65D 88/02* (2006.01)

(58) Field of Classification Search
USPC ..... 220/6, 1.5, 7, 4.28, 4.29, 4.33; 24/287
See application file for complete search history.

(56) References Cited

U.S. PATENT DOCUMENTS

| | | | | |
|---|---|---|---|---|
| 7,870,970 | B2 * | 1/2011 | Fisk | B65D 88/022 220/4.28 |
| 8,733,803 | B2 | 5/2014 | Drumm | |
| 2006/0016807 | A1 | 1/2006 | Hsu et al. | |
| 2007/0252058 | A1 | 11/2007 | Drumm | |
| 2012/0248105 | A1 * | 10/2012 | Leong | B65D 88/524 220/7 |
| 2013/0026769 | A1 | 1/2013 | Drumm | |
| 2014/0175090 | A1 * | 6/2014 | Bellehumeur | B65D 88/524 220/1.5 |

FOREIGN PATENT DOCUMENTS

| | | | |
|---|---|---|---|
| CN | 101164839 | A | 4/2008 |
| CN | 201264785 | Y | 7/2009 |
| CN | 101966898 | A | 2/2011 |
| CN | 202953343 | U | 5/2013 |
| CN | 202953357 | U | 5/2013 |
| CN | 203127543 | U | 8/2013 |
| CN | 204528188 | U | 8/2015 |
| CN | 105644971 | A | 6/2016 |
| EP | 1840307 | A2 | 10/2007 |
| EP | 3219644 | A1 | 9/2017 |
| SU | 1294708 | A1 | 3/1987 |
| WO | 2006024104 | A1 | 3/2006 |
| WO | 2010075607 | A1 | 7/2010 |
| WO | 2016074490 | A1 | 5/2016 |

OTHER PUBLICATIONS

Extended European Search Report dated Jun. 26, 2018, eight (3) pages, European Patent Office.

* cited by examiner

CONNECTING MECHANISM AND COLLAPSIBLE CONTAINER COMPRISING THE SAME

CROSS-REFERENCE TO RELATED APPLICATIONS

This application is the National Stage of International PCT Application No. PCT/CN2015/083396 filed on Jul. 6, 2015, which claims the benefit of priority to Chinese Patent Application No. 201410640576.4, filed with the State Intellectual Property Office of China on Nov. 13, 2014, each of which is herein incorporated by reference in its entirety.

BACKGROUND

The present invention relates to the field of container, and especially relates to a connecting mechanism and a collapsible container comprising the same.

The dry cargo container is a large-scale vessel among the containers that is most widely used and has gotten the largest usage, in which the containers of 20 feet, 40 feet and 40 feet in height obtain the most common application, and the corresponding transport vehicles, ships and handling equipments all have been standardized. The conventional dry cargo container is of a fixed type in its structure, which provides many advantages, such as simple structure, low cost, light weight, high strength, good rigidity, easy maintenance, easy loading and unloading, however, there are also obvious drawbacks. The dry cargo containers often needs to be stacked and temporarily stored in an empty state after its goods is unloaded, but due to the conventional dry cargo container of a fixed structure has a bulky volume, it will take up a lot of storage space, causing a greater storage cost. When transporting goods from one location to another one, there is frequently the transfer of the empty containers, since the conventional dry cargo container of a fixed structure is bulky in its volume, although the weight of an empty container is not large, the truck or container ship has the same loading capacity when transporting the empty container as that when transporting the loaded container, and the loading capacity can not be increased due to the light weight of the empty containers. This makes the transportation cost irreducible, causing a huge wastage.

As the conventional dry cargo container has the above drawbacks, there exits a high need for the arrangement capable of overcoming the problem of empty container transportation, its leading driving force is to significantly reduce the transportation and storage cost, and its secondary driving force is the environmental issues and the tendency of low-carbon expanding economy. The collapsible container can significantly reduce the empty container transportation expenses and empty container storage cost, thus it has gotten widespread concern around the world and the continued development of many professional corporations. After several decades of endeavors, many forms of collapsible containers have been developed, and a large number of patents have been applied for correspondingly, but so far, there isn't yet one of them that has been applied in large quantities. The main reason is that the problems brought by the folding functionality of the collapsible container have not been finely solved, primarily: its structural stability, sealability, operability and the like. Therefore, it is necessary to continue the research and development to propose an acceptable solution.

The mechanized folding and assembling of the containers could save considerable manpower, and also could enormously promote the folding and assembling efficiency, satisfies actual demands when the container is in use, this makes the collapsible container practical, and the customers are more receptive to such a new mode of collapsible containers. However, in prior art, there are still problems in the mechanized folding and assembling aspects of the collapsible container, which needs to propose a new solution.

SUMMARY

In this SUMMARY section, a series of simplified concepts are introduced which will get a further detailed description in the DETAILED DESCRIPTION section. The SUMMARY section of the present invention does not intend to define the critical features and the essential technical features of the claimed technical solution, nor intend to determine the protection reach of the claimed technical solution.

To overcome the above problems, the present invention discloses a connection mechanism for a collapsible container, the collapsible container comprises a top cover and a chassis, the four corners of the top cover is provided with a top corner piece which is connected with a top cover corner pillar, and the four corners of the chassis is provided with a bottom corner piece which is connected with a chassis corner pillar, characterized in that the connecting mechanism comprises:

A crook lug located at one of the top cover corner pillar and the chassis corner pillar; and A crook locking plate rotatablely provided at the outer end face of the other of the top cover corner pillar and the chassis corner pillar, the first end of the crook locking plate is provided with a crook part cooperating with the crook lug.

Alternatively, the crook lug extends and protrudes from the outer end face of the one of the top cover corner pillar and the chassis corner pillar.

Alternatively, the connecting mechanism further comprises a crook locking plate shaft by means of which the crook locking plate is hinged with the other of the top cover corner pillar and the chassis corner pillar.

Alternatively, the connecting mechanism further comprises an elastic element, one end of which abuts against the outer end face of the other of the top cover corner pillar and the chassis corner pillar and the other end of which abuts against the crook locking plate.

Alternatively, the crook locking plate is provided with a groove for receiving the elastic element, and the elastic element abuts against the bottom surface of the groove.

Alternatively, the connecting mechanism further comprises a stopper mechanism detachably connected with the crook locking plate.

Alternatively, the stopper mechanism is provided at the outer end face of the other of the top cover corner pillar and the chassis corner pillar.

Alternatively, the stopper mechanism comprises a first stopper and a first stopper shaft, the first end of the first stopper is provided with a hole through which the first stopper shaft passes to be hinged with the other of the top cover corner pillar and the chassis corner pillar, the second end of the first stopper is provided with a stopper crook cooperating with the second end of the crook locking plate.

Alternatively, at least one of the second end of the crook locking plate and the second end of the first stopper is provided with a first guiding inclined plane.

Alternatively, the stopper mechanism is provided at the outer end face of the one of the top cover corner pillar and the chassis corner pillar.

Alternatively, the stopper mechanism comprises a second stopper and a second stopper shaft, the first end of the second stopper is provided with a hole through which the second stopper shaft passes to be hinged with the one of the top cover corner pillar and the chassis corner pillar, the second stopper cooperates with the crook locking plate.

Alternatively, the connecting mechanism further comprises stop block for restraining the second stopper, and the stop block is provided at the one of the top cover corner pillar and the chassis corner pillar.

Alternatively, the second end of the second stopper is provided with a handle.

Alternatively, at least one of the first end of the crook locking plate and the crook lug is provided with a second guiding inclined plane.

Alternatively, the first end of the crook locking plate is provided with an operating panel laterally protruding from the crook locking plate.

Alternatively, the first end of the crook locking plate is provided with an operating panel laterally protruding from the crook locking plate, and the operating panel cooperates with the second stopper.

Alternatively, the crook locking plate is provided at a location in contact with the unlock piece on the hoist bracket of the collapsible container, and when the collapsible container is in a folded state, the unlock piece on the hoist bracket contacts with the crook locking plate to disengage the crook locking plate from the crook lug.

The present invention also discloses a collapsible container comprising the above connection mechanism.

The connection mechanism of the present invention is convenient, fast and reliable to operate, and does not occupy the useful space of the container, does not affect the folding and sealing of the container and does not exceed the external dimensions of the container, and has no parts separated from the container, such a connection mechanism is especially suitable for the mechanized folding and assembling operations of the collapsible container.

BRIEF DESCRIPTION OF THE DRAWINGS

In the following, a detailed description will be made about the advantages and features of the present invention in conjunction with the drawings. The drawings of the present invention listed below are used as a part of the present invention herein for the understanding of the present invention. The drawings illustrate the embodiments of the present invention and its description, so as to explain the principle of the present invention. In which.

DETAILED DESCRIPTION

The description hereinafter gives a large quantity of specific details so as to provide a thorough understanding of the present invention. However, as obvious to the skilled in this art, the present invention may be implemented without one or more of these details. Some of the technical features well-know in this art are not described in other examples so as not to confuse with the embodiment of present invention.

A detailed structure would be proposed in the following description for the purpose of thorough understanding the embodiment of present invention. Apparently, the implementation of the embodiment of present invention is not limited to special details known by the skilled in this art. The preferred embodiments of the present invention are described in detail as follows, however, the present invention can also comprise other embodiments besides these detailed description.

Figure 1:
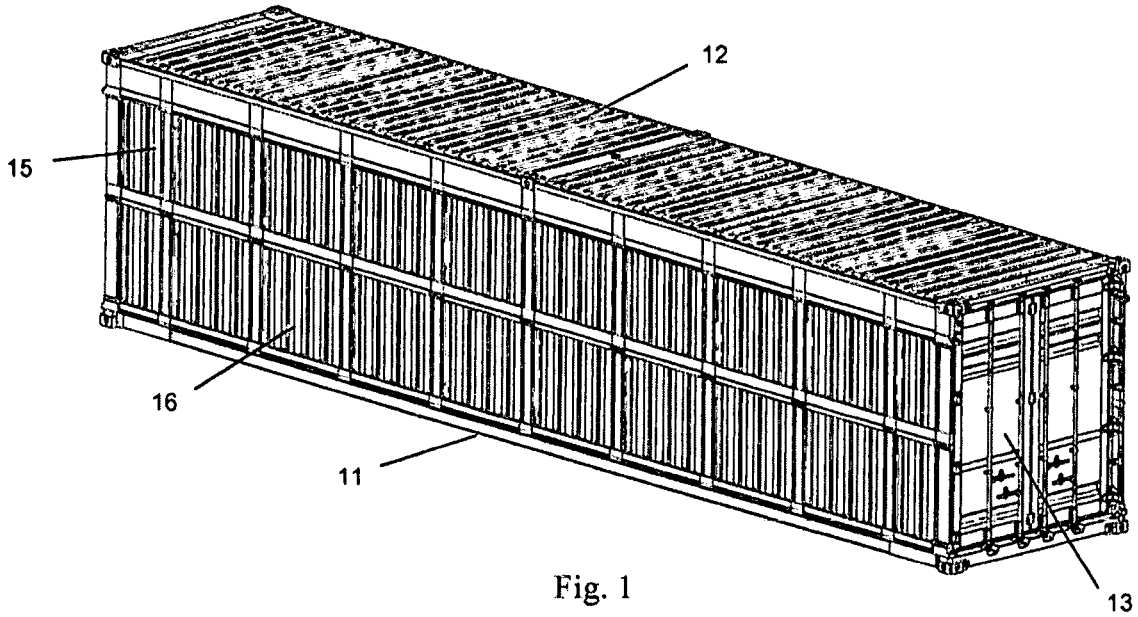
FIG. 1 is a view showing the door of the collapsible container of the present invention.
Figure 2:
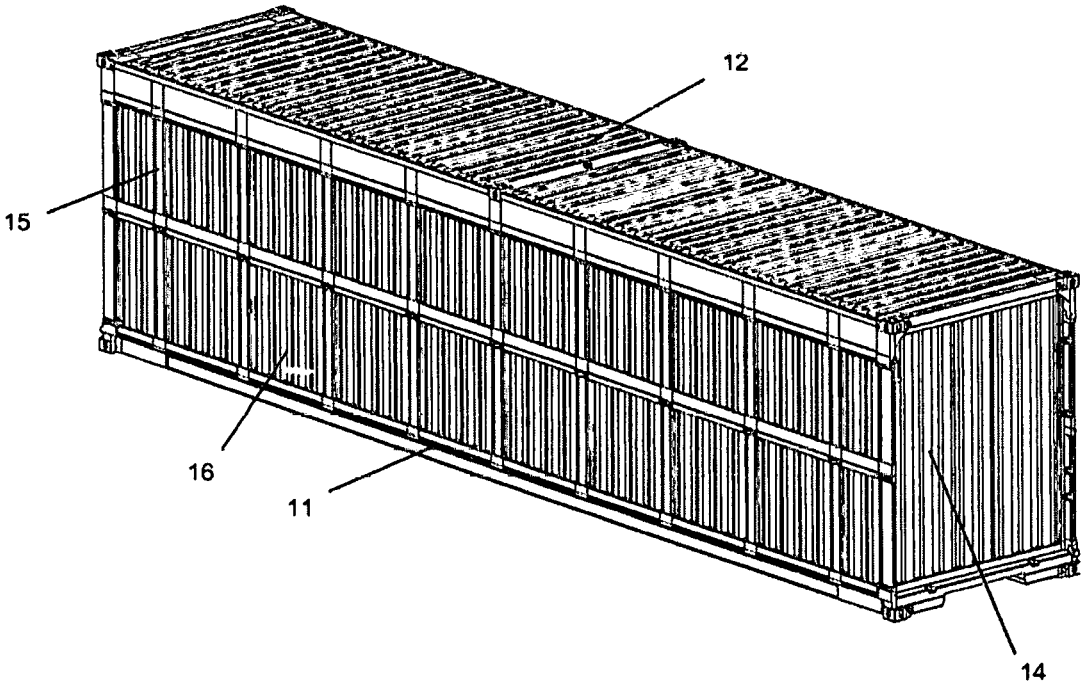
FIG. 2 is an end view of the collapsible container of the present invention.
Figure 3:
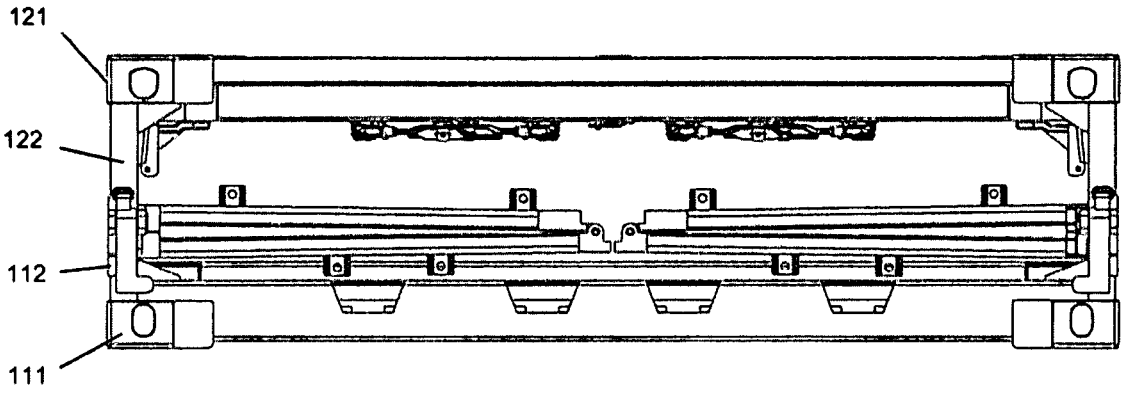
FIG. 3 is an end view of the collapsible container of the present invention after being folded.

As shown in FIGS. 1 to 3, the present invention discloses a connection mechanism for connecting the folded collapsible container, and specifically, the collapsible container comprises one chassis 11, one top cover 12, a rear end wall 13, a front end wall 14 and two side walls. The upper ends of the rear end wall 13 and the front end wall 14 are hinged at the top cover 12, and when being folded, overturn toward the inside of the container, and abut against and are secured onto the container inner face of the top cover 12. Each of the side wall comprises a upper side wall 15 and a lower side wall 16, the topside of the upper side wall 15 is hinged with the side of the top cover 12, and the bottom side of the lower side wall 16 is hinged with the side of the chassis 11, the bottom side of the upper side wall 15 is hinged with the topside of the lower side wall 16. After the folding of the end walls, the side walls 15 and 16 are folded in a direction of the inside of the container, and at the same time, the top cover 12 falls down, thus completing the folding of the container, and the assembling process is reversed.

Figure 4:
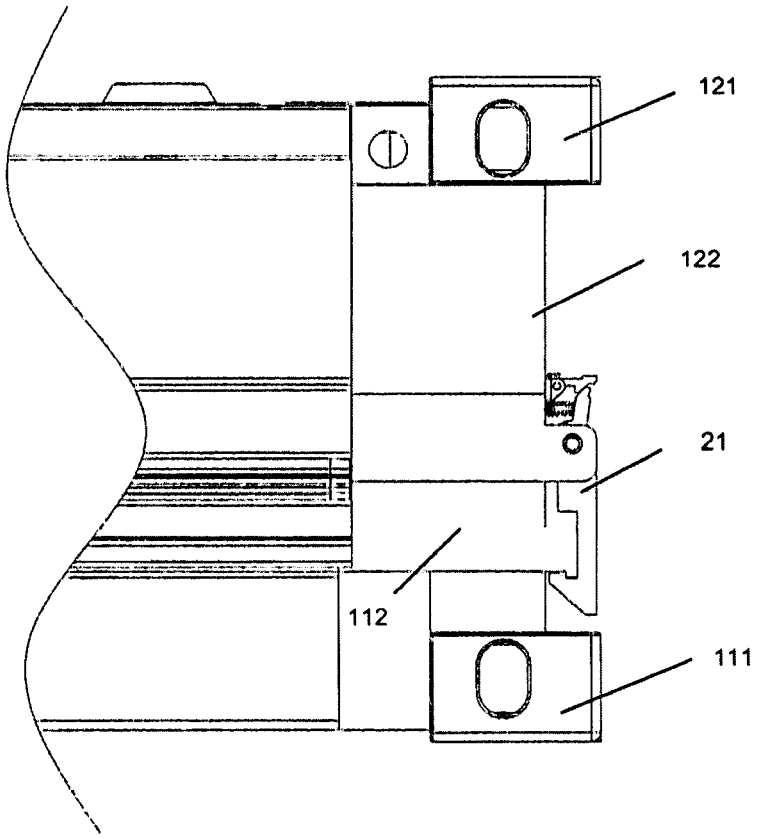
FIG. 4 is a structural schematic view of the connection mechanism of the first embodiment of the present invention.

As shown in FIGS. 3 and 4, the four corners of the top cover 12 are provided with a corner piece 121, a top cover corner pillar 122 is provided below the corner piece 121, and the four corners of the chassis 11 is provided with a bottom corner piece 111, a chassis corner pillar 112 is provided above the bottom corner piece 111.

The connection mechanism of the present invention comprises a crook lug 23 and a crook locking plate 21. The present invention will be explained hereinafter in the case that the crook locking plate 21 is located on the top cover corner pillar 122 and the crook lug 23 is located on the chassis corner pillar 112. Absolutely, the crook locking plate 21 may also be provided on the chassis corner pillar 112 while the crook lug 23 is provided on the top cover corner pillar 122.

Figure 5:
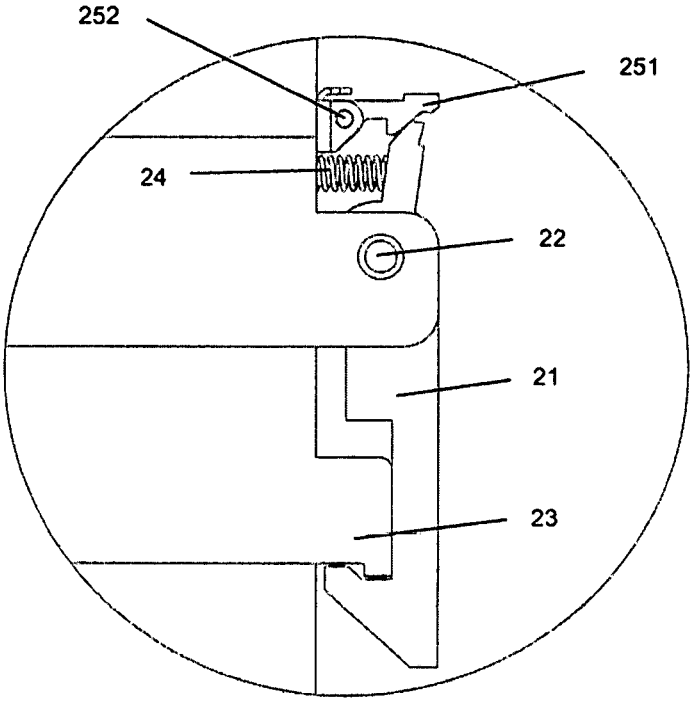
FIG. 5 is a enlarged schematic view of the connection mechanism of the first embodiment of the present invention.
Figure 6:
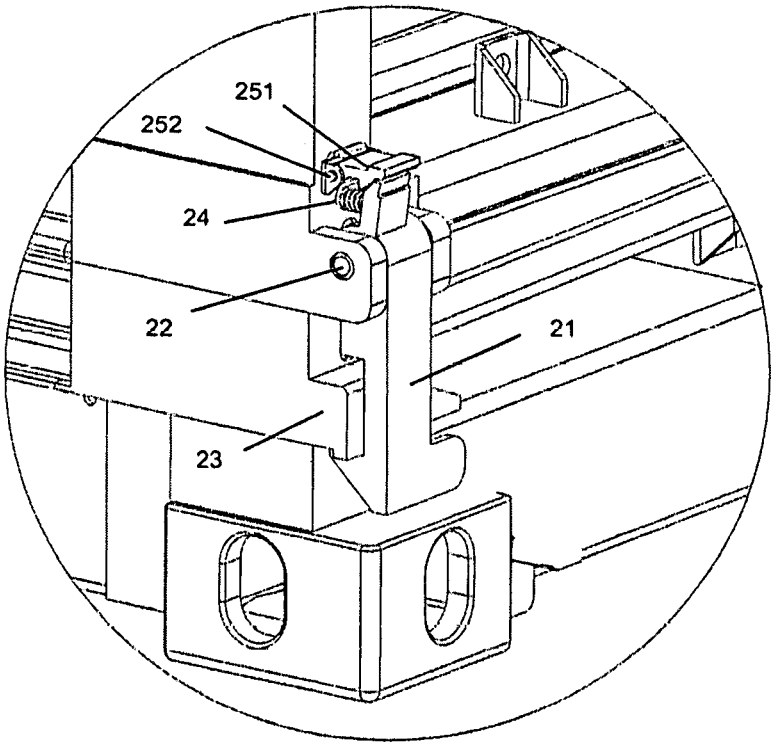
FIG. 6 is a perspective view of FIG. 5.

As shown in FIGS. 5 and 6, the crook lug 23 is provided on the chassis corner pillar 112, and the crook locking plate 21 is rotatablely provided at the outer end face of the top cover corner pillar 122. To be specified, herein and hereafter, the term "outer end face" refers to the outer end face of the pillar (the top cover corner pillar 122 and the chassis corner pillar 112) in the longitudinal direction of the collapsible container, for example, the outer end face of the top cover corner pillar 122 means the outer end face of the top cover corner pillar 122 in the longitudinal direction of the collapsible container.

Figure 7:
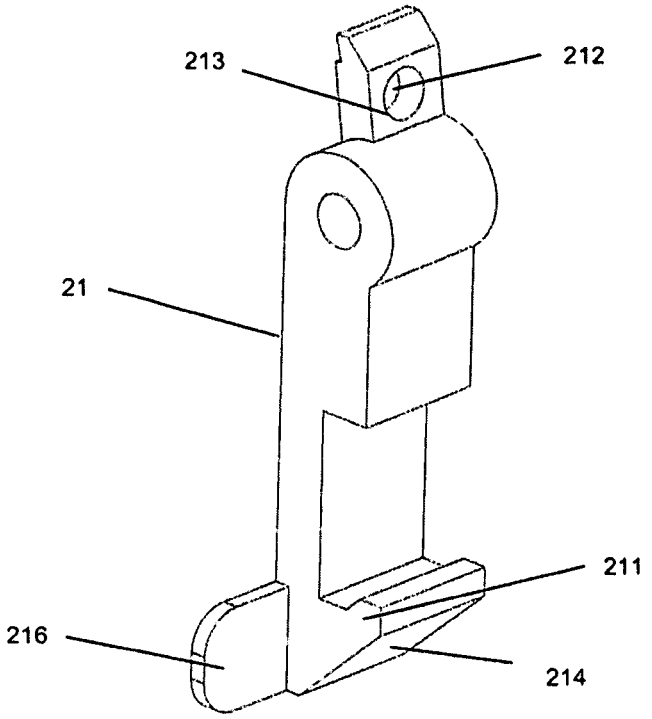
FIG. 7 is a perspective view of the crook locking plate of the first embodiment of the present invention

As shown in FIG. 7, the crook locking plate 21 is provided with a crook part 211 cooperating with the crook lug 23, and alternatively, the crook lug 23 extends to protrude from the outer end face of the chassis corner pillar 112.

The connection mechanism of the present invention could realize the automatic connection of the top cover 12 with the chassis 11 when the container is folded, and when assembling the container, only a simple or even no manual operation is needed, its operational efficiency is high. Due to the fact that the installation location of the connection mechanism is the existing space outside of the container of a general container (the space of a general container for assembling the door hinge, the structure of the collapsible container of the present invention makes this space unusable, and this space can be utilized by the connection mechanism of the present invention), therefore the connection mechanism does not affect the internal dimensions of the container. The present connection mechanism has a large strength, and can satisfy the suspended ceiling shipment for one unit formed by stacking four or more folded containers.

The connection mechanism of the present invention is convenient, fast and reliable to operate, and does not occupy the useful space of the container, does not affect the folding and sealing of the container and does not exceed the external dimensions of the container, and has no parts separated from the container, such a connection mechanism is especially suitable for the mechanized folding and assembling operations of the collapsible container.

Specifically, as shown in FIGS. 5 and 6, the crook locking plate 21 could be hinged with the top cover corner pillar 122 by means of the crook locking plate shaft 22.

Referring to FIGS. 5 and 6 again, optionally, the connection mechanism further comprises an elastic element 24, the first end of the elastic element 24 abuts against the outer end face of the top cover corner pillar 122, and the second end of the elastic element 24 abuts against the crook locking plate 21. Further optionally, as shown in FIG. 7, the crook locking plate 21 is provided with a groove 213 for receiving the elastic element 24, the elastic element 24 abuts against the bottom surface 212 of the groove.

Figure 9:
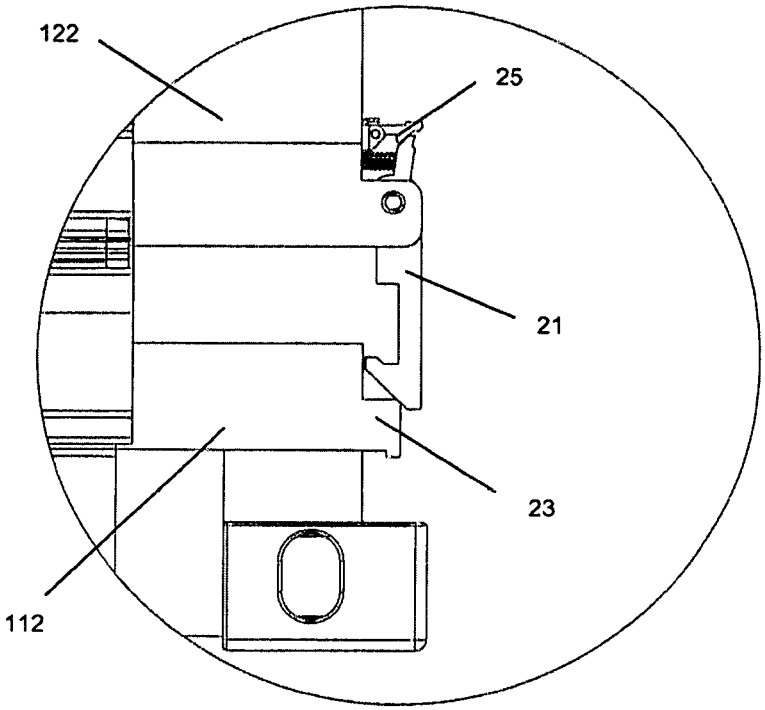
FIG. 9 is a schematic view showing the folding process of the collapsible container of the first embodiment of the present invention.
Figure 11:
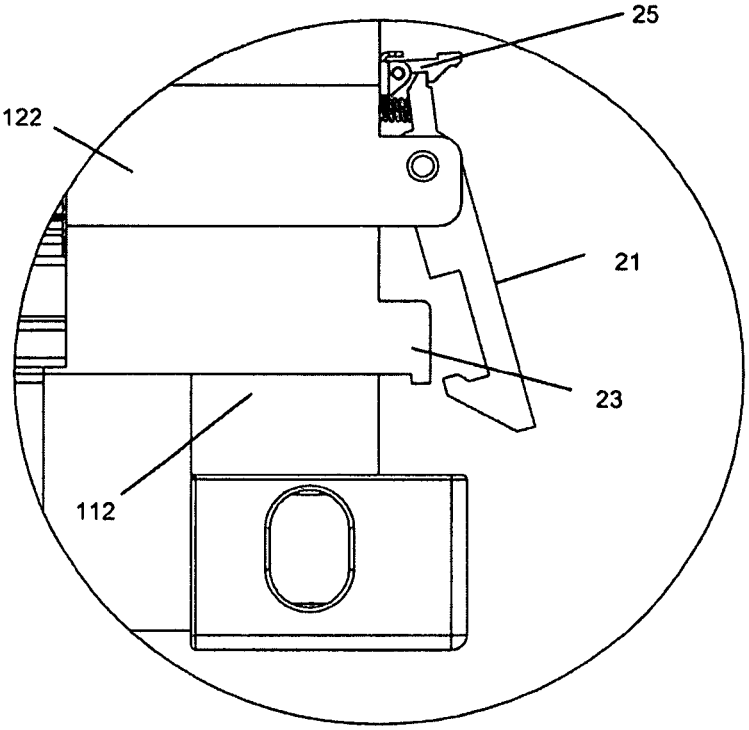
FIG. 11 is a schematic view showing the assembling process of the collapsible container of the first embodiment of the present invention.

As shown in FIGS. 9 and 11, to secure the crook locking plate 21, a stopper mechanism 25 can also be provided to be detachably connected with the crook locking plate 21.

As shown in FIG. 7, to enable the crook locking plate 21 to even more smoothly connect with the crook lug 23, at least one of the first end of the crook locking plate 21 and the crook lug 23 could be provided with a second guiding inclined plane, and in the crook locking plate 21 shown in FIG. 7, the second guiding inclined plane 214 is provided at the first end of the crook locking plate 21.

Referring to FIGS. 5 to 11, the first embodiment of the present invention is illustrated. In the illustrated embodiment, the second end of the crook locking plate 21 is provided with an elastic element 24 which abuts between the top cover corner pillar 122 and the crook locking plate 21. The crook lug 23 is provided at the outer end face of the chassis corner pillar 112. The stopper mechanism 25 is provided at the outer end face of the top cover corner pillar 122.

Figure 8:
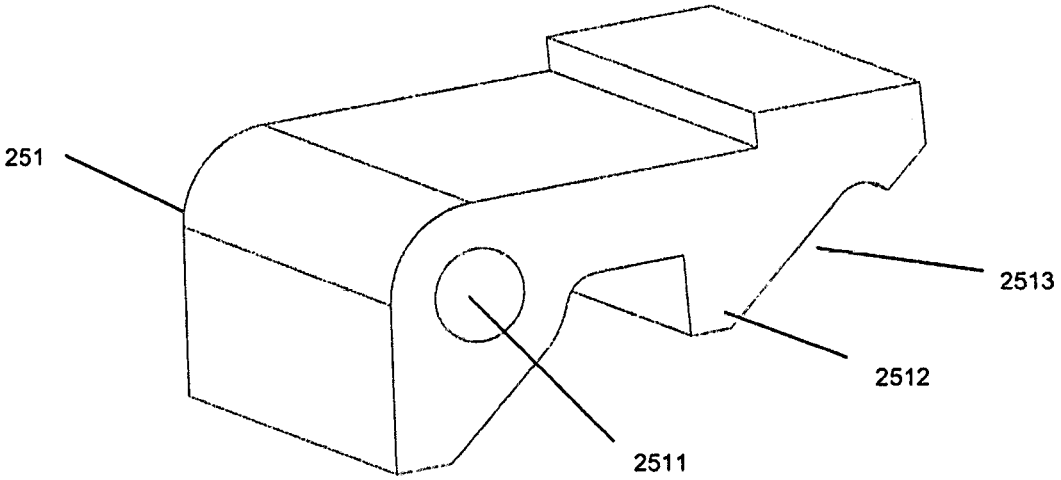
FIG. 8 is a perspective view of the first stopper of the first embodiment of the present invention.

As shown in FIGS. 5 and 8, when attaching the stopper mechanism 25 onto the top cover corner pillar 122, the stopper mechanism 25 may comprise a first stopper 251 and a first stopper shaft 252. The first end of the first stopper 251 is provided with a hole 2511, through which the first stopper shaft 252 passes to be hinged with the top cover corner pillar 122 in a manner as shown in the illustrated embodiment that the outer end face of the top cover corner pillar 122 is further provided with a base and the first stopper shaft 252 is hinged with this base; it is also possible to provide a groove at the outer end face of the top cover corner pillar 122, thus the first stopper shaft is hinged with the top cover corner pillar 122.

The second end of the first stopper 251 has a stopper crook 2512, and in the present embodiment, the first stopper 251 is located above the crook locking plate shaft 22. The stopper crook 2512 may be connected with the second end of the crook locking plate 21 so as to reach the purpose of restricting the crook locking plate 21. Alternatively, at least one of the second end of the crook locking plate 21 and the first stopper 251 may be provided with a first guiding inclined plane, as shown in FIG. 8, the first stopper 251 is provided with a first guiding inclined plane 2513 thereon. As a result, the second end of the crook locking plate 21 is caused to contact with the first stopper 251 even more smoothly.

Figure 10:
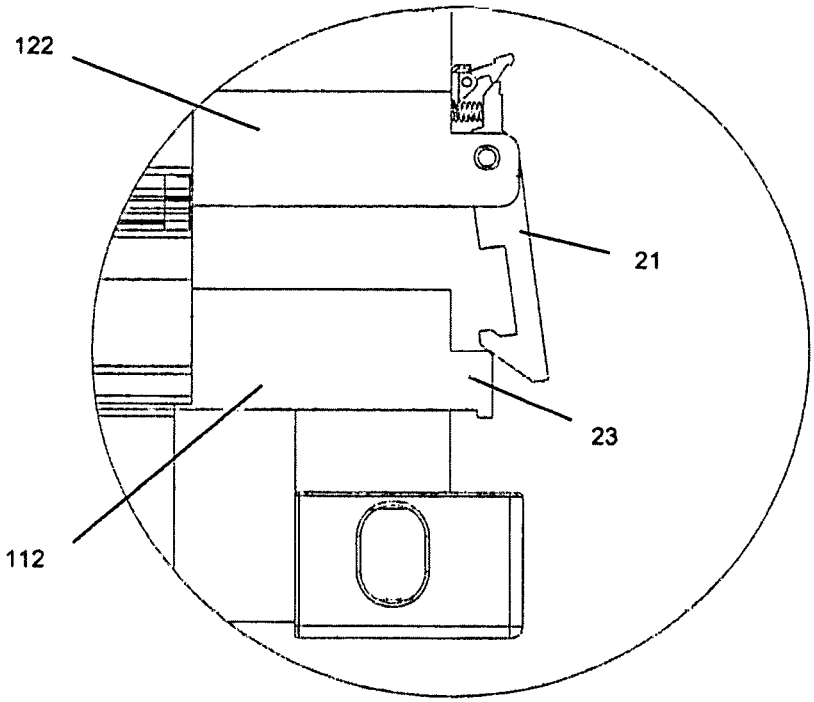
FIG. 10 is another schematic view showing the folding process of the collapsible container of the first embodiment of the present invention.

As shown in FIGS. 9 and 10, when folding the collapsible container, the crook locking plate 21 is lowered together with the top cover 12, when the crook locking plate 21 contacts with the crook lug 23, the first end of the crook locking plate 21 is supported apart under the action of the second guiding inclined plane 214, and the second end of the crook locking plate 21 compresses the elastic element 24 so that the elastic element 24 is compressed and deforms, when the first end of the crook locking plate 21 has its crook part 211 pass over the crook lug 23, the restoring force of the elastic element 24 causes the crook locking plate 21 to rotate back into its initial position, and by this time, the crook part 211 of the crook locking plate 21 is hooked with the crook lug 23, and the top cover corner pillar 122 exactly rests onto the chassis corner pillar 112. The elastic element 24 enables the top cover 12 keep connection with the chassis 11 all the time in the process of handling and transporting the collapsible container.

As shown in FIG. 11, when assembling the container, the crook locking plate 21 is firstly rotated outward, hence the elastic element 24 is compressed, when the stopper mechanism 25 is mounted onto the top cover corner pillar 122 as shown in the drawings, the second end of the crook locking plate 21 contacts with the first stopper 251, and under the action of the first guiding inclined plane 2513, the first stopper 251 is supported apart, when the second end of the crook locking plate 21 passes over the stopper crook 2512 of the first stopper 251, the first stopper 251 rotates back into its initial position under the dead weight of the first stopper 251 or under the action of an stop elastic element, such as the spring provided inside of the first stopper 251. By this time, the first stopper 251 and the crook locking plate 21 are hooked together, but the crook locking plate 21 is disengaged from the crook lug 23, so that the collapsible container can be assembled.

After the assembling of the collapsible container, the first stopper 251 can be manually disengaged from the crook locking plate 21, and under the action of the elastic element 24, the crook locking plate 21 rotates to its initial position.

Figure 12:
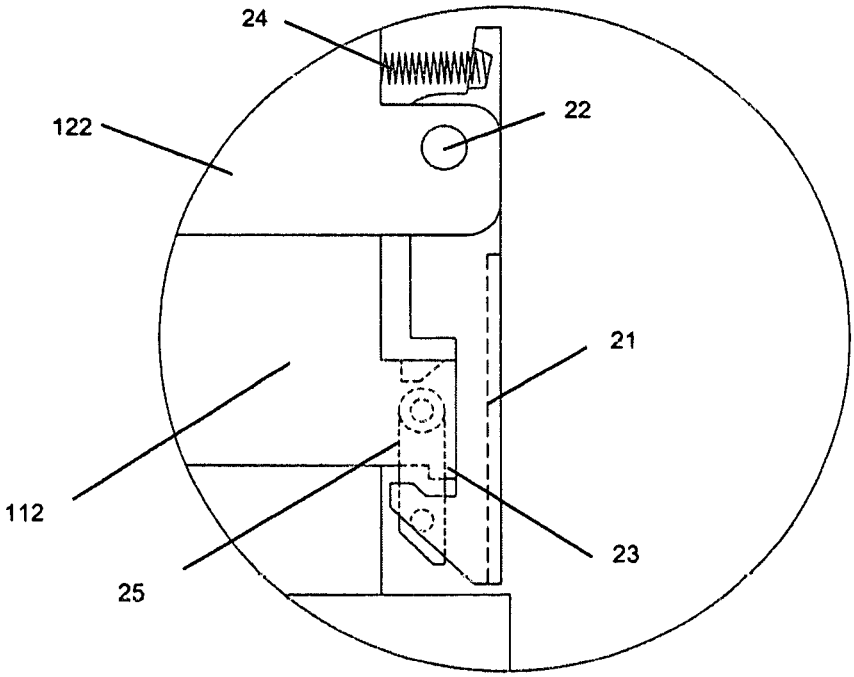
FIG. 12 is a enlarged schematic view of the connection mechanism of the second embodiment of the present invention.
Figure 13:
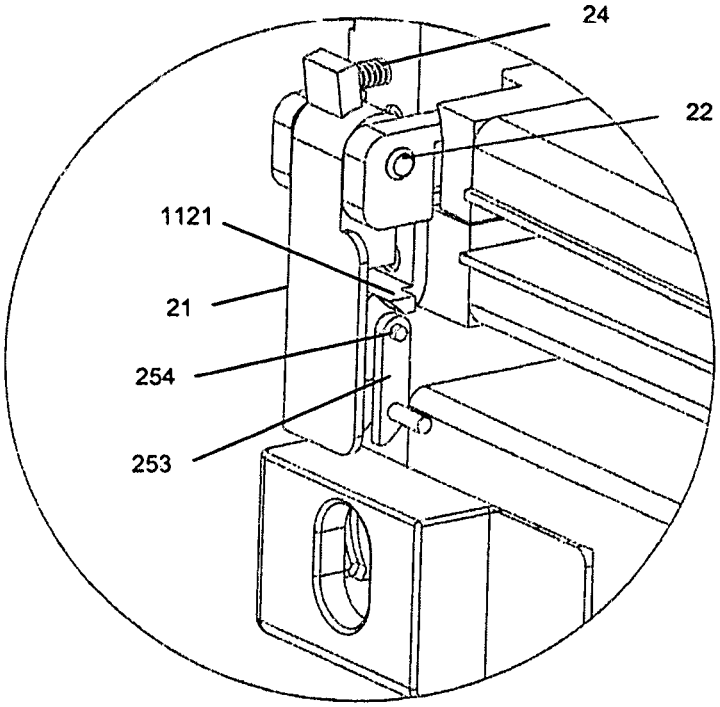
FIG. 13 is a perspective view of FIG. 12.
Figure 15:
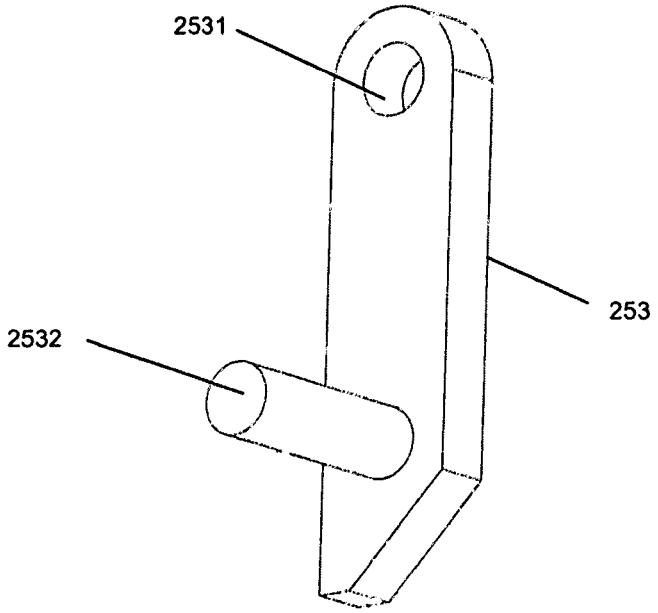
FIG. 15 is a perspective view of the second stopper of the second embodiment of the present invention.

As shown in the second embodiment illustrated in FIGS. 12-13 and 15, the second embodiment differs from the first embodiment in that the stopper mechanism 25 may be provided on the chassis corner pillar 112. In the illustrated embodiment, the stopper mechanism 25 comprises a second stopper 253 and a second stopper shaft 254, the first end of the second stopper 253 is provided with a hole 2531. The second stopper 253 is hinged with the chassis corner pillar 112 by means of the second stopper shaft 254 passing through the hole 2531, in the illustrated embodiment, the second stopper 253 is located below the crook locking plate shaft 22. Naturally, the second stopper shaft 254 may also be a portion of the chassis corner pillar 112 protruding outward.

Figure 16:
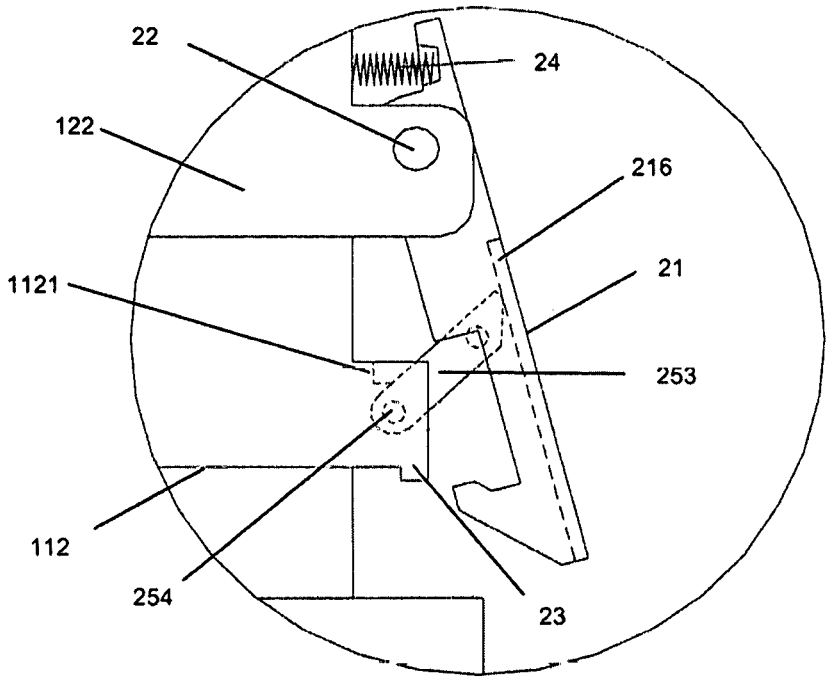
FIG. 16 is a schematic view showing the assembling process of the collapsible container of the second embodiment of the present invention.

As shown in FIGS. 15 and 16, in an optional embodiment, alternatively, the second end of the second stopper 253 away from the hole (the first end) is provided with a handle 2532. Optionally, the connection mechanism further comprises a stop block 1121 for restricting the second stopper 253, and the stop block 1121 may be provided at the chassis corner pillar 112.

Figure 14:
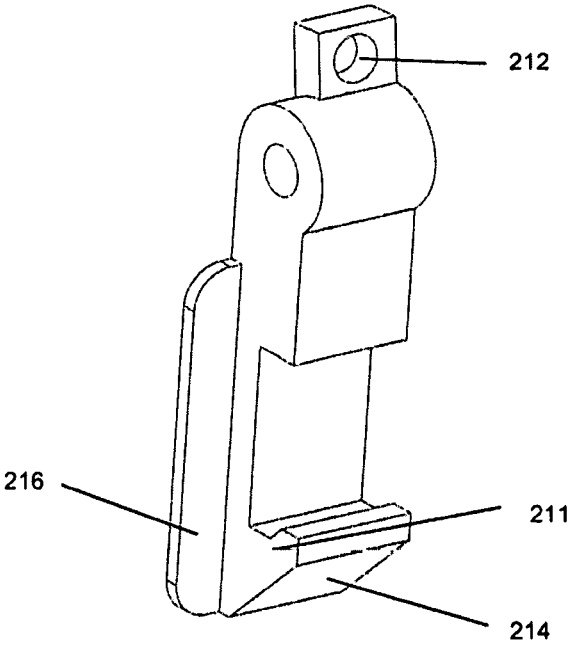
FIG. 14 is a perspective view of the crook locking plate of the second embodiment of the present invention

Before assembling the container, the crook locking plate 21 is manually rotated outward, then the handle 2532 is operated to rotate the second stopper 253 upwardly by an upward angle so as to abut against the stop block 1121, the second end of the second stopper 253 away from the second stopper shaft 254 rests against the crook locking plate 21. As shown in FIG. 14, optionally, the first end of the crook locking plate 21 is provided with an operating panel 216 laterally protruding from the crook locking plate 21.

Figure 17:
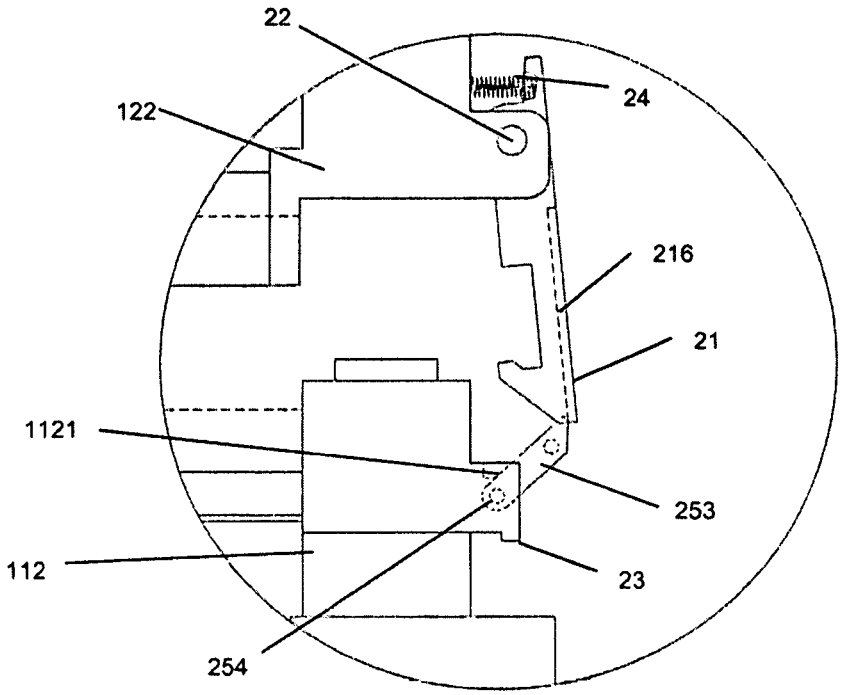
FIG. 17 is another schematic view showing the assembling process of the collapsible container of the second embodiment of the present invention.
Figure 18:
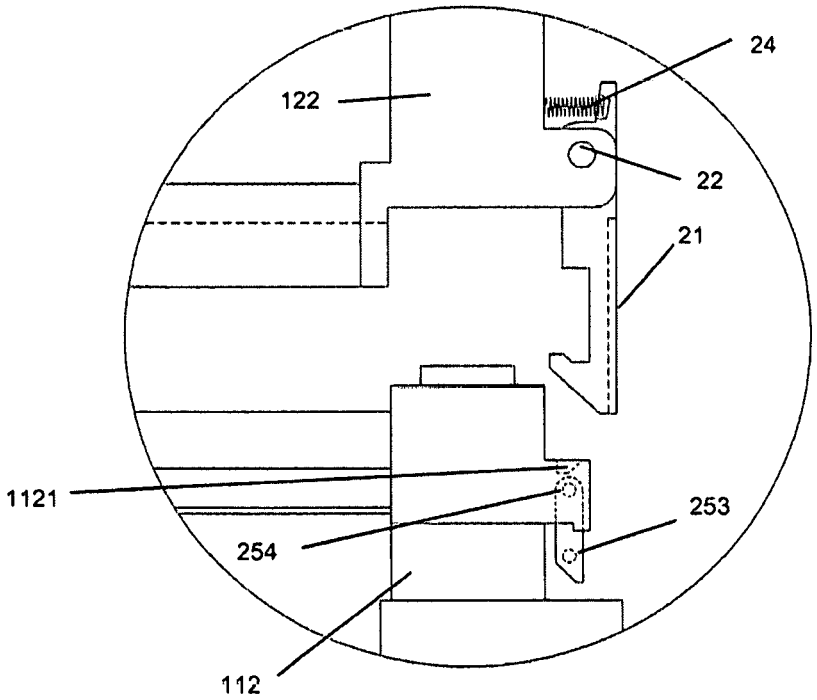
FIG. 18 is still another schematic view showing the assembling process of the collapsible container of the second embodiment of the present invention.

By this time, the operating panel 216 of the crook locking plate 21 is required to be longer so as to in contact with the second stopper 253, so that the crook locking plate 21 is supported by the second stopper 253. By this time, the crook locking plate 21 disengages from the crook lug 23, thus the collapsible container may be assembled. As shown in FIG. 17, in the process of assembling the collapsible container, the crook locking plate 21 ascends together with the top cover 12, due to the action of the elastic element 24, the crook locking plate 21 presses against the second stopper 253 all the time so that the crook locking plate 21 is kept in a state of being supported apart all the time. As shown in FIG. 18, when the crook locking plate 21 disengages from the second stopper 253, the crook locking plate 21 is rotated into its initial position under the action of the elastic element 24. Under the dead weight of the second stopper 253 or under the action of a stop elastic element, such as the spring provided on the second stopper 253, the second stopper 253 rotates back into its initial position. When folding the collapsible container, the connecting action and its principle of the connection mechanism between the top cover and the chassis are the same to that of the first embodiment.

Alternatively, the crook locking plate 21 is provided at a location in contact with the unlock piece on the hoist bracket of the collapsible container, and when the collapsible container is in a folded state, the unlock piece on the hoist bracket contacts with the crook locking plate to disengage the crook locking plate 21 from the crook lug 23. The unlock piece is movable with respect to the hoist bracket.

Figure 19:
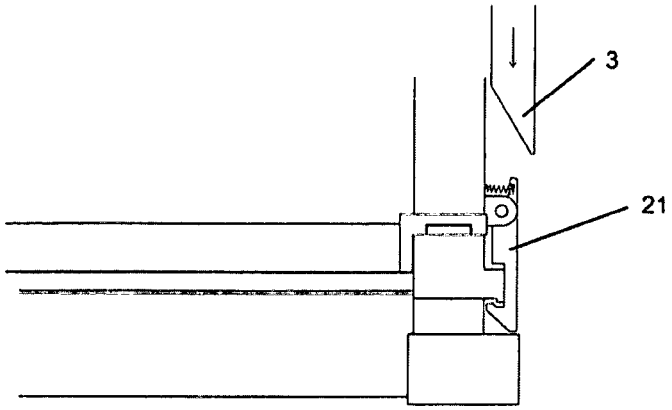
FIG. 19 is a schematic view showing the process of connecting a crook locking plate with a hoist bracket comprising a sliding part of the present invention.
Figure 20:
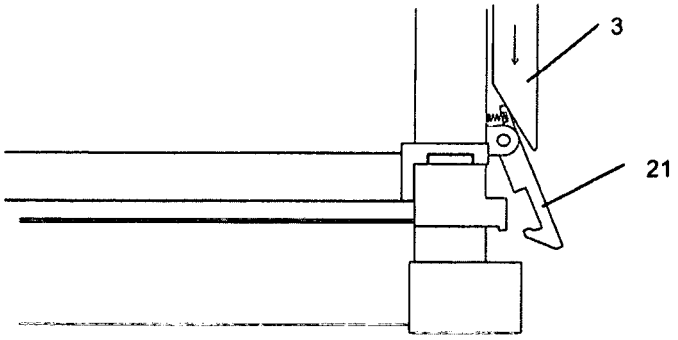
FIG. 20 is another schematic view showing the process of connecting a crook locking plate with a hoist bracket comprising a sliding part of the present invention.
Figure 21:
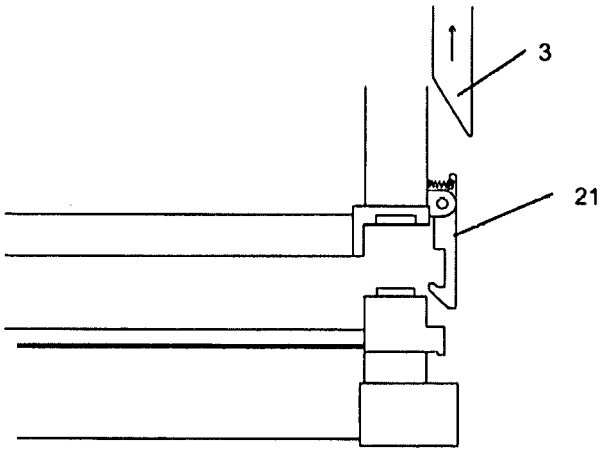
FIG. 21 is a schematic view showing the process of disconnecting a crook locking plate from a hoist bracket comprising a sliding part of the present invention.

As shown in FIG. 19, the unlock piece is a kind of sliding part, when the collapsible container is in its folded state and begins to be assembled, after the hoist bracket, such as the one located at the dock, descends to connect with the top cover of the collapsible container, the sliding part 3 provided on the hoist bracket moves downward and contacts firstly with the second end of the crook locking plate 21, similarly, the crook locking plate 21 or the sliding part 3 may be provided with an inclined face thereon. As shown in FIG. 20, after the sliding part 3 moves downward, it presses upon the second end of the crook locking plate 21, as a result, the crook locking plate 21 is released from the crook lug 23. As shown in FIG. 21, the hoist bracket lifts the top cover 12 of the collapsible container so that the crook locking plate 21 is separated from the crook lug 23 and then the sliding part 3 is moved upward from the crook locking plate 21, thus the crook locking plate 21 is returned to its original state. As the hoist bracket is lifting and shipping the collapsible container in its folded state, the unlock piece has no action. Undoubtedly, the provision of the sliding part 3 is not limited to the manner as shown in the illustrated embodiments, the cooperation of the sliding part 3 and the crook locking plate 21 may also be other cooperation with the crook locking plate 21 by means of electrically-controlled members, for example.

Figure 22:
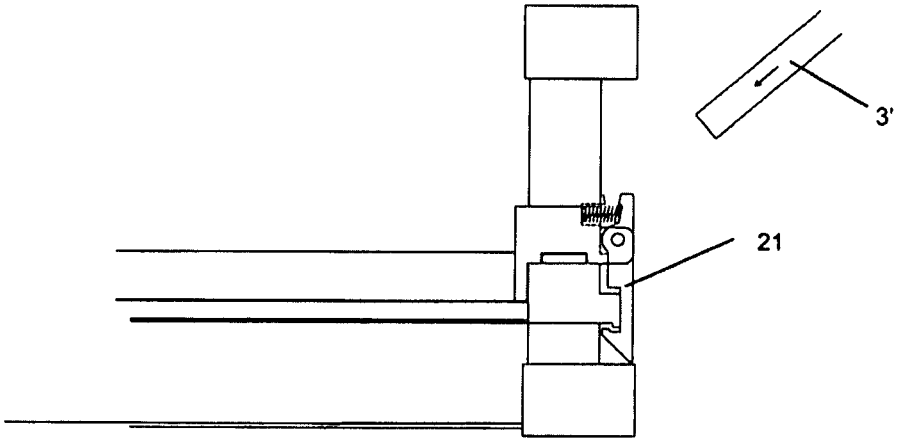
FIG. 22 is a schematic view showing the process of connecting a crook locking plate with a hoist bracket comprising another kind of sliding part of the present invention.
Figure 23:
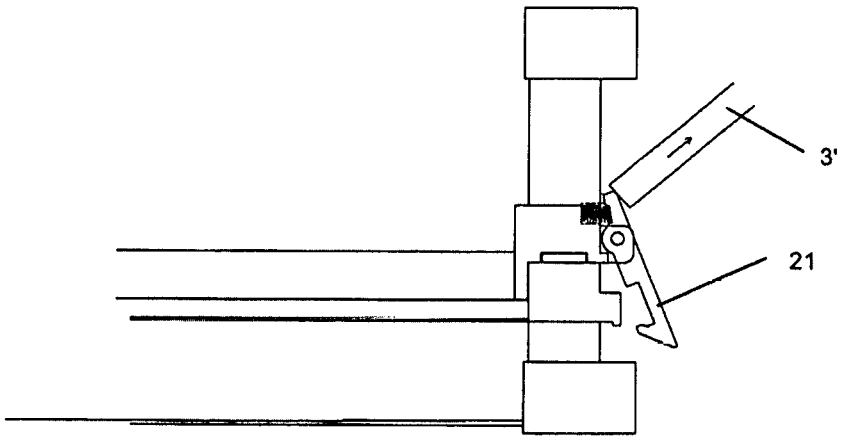
FIG. 23 is a schematic view showing the process of disconnecting a crook locking plate from a hoist bracket comprising another sliding part of the present invention.

Now turn to FIGS. 22 and 23, FIG. 22 illustrates another kind of sliding part 3', which, similar to the sliding part 3 in the embodiment shown in FIG. 19, may be provided on the hoist bracket. However, the sliding part 3' of the present embodiment is inclined to the vertical direction, in this way, the sliding part 3' may keep away from the corner piece 121. When the sliding part 3' acts, it will firstly contact with the second end of the crook locking plate 21 so that the crook locking plate 21 is released from the crook lug 23. As shown in FIG. 23, now the hoist bracket lifts the top cover 12 of the collapsible container, and the sliding part 3' may move away from the crook locking plate 21, as a result, the crook locking plate 21 is caused to return to its original state.

Undoubtedly, the sliding part 3' may move together with the hoist bracket so as to contact or move away from the crook locking plate 21. The sliding part 3' may also be configured to have its separate power supply, for example an air cylinder or an oil cylinder, so as to operate the crook locking plate 21 independent of the hoist bracket.

Figure 24:
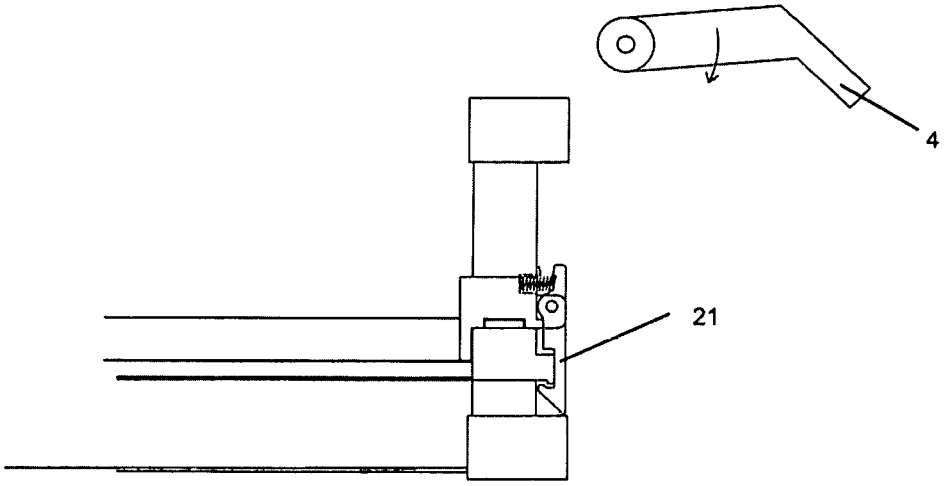
FIG. 24 is a schematic view showing the process of connecting a crook locking plate with a hoist bracket comprising a swingable part of the present invention.
Figure 25:
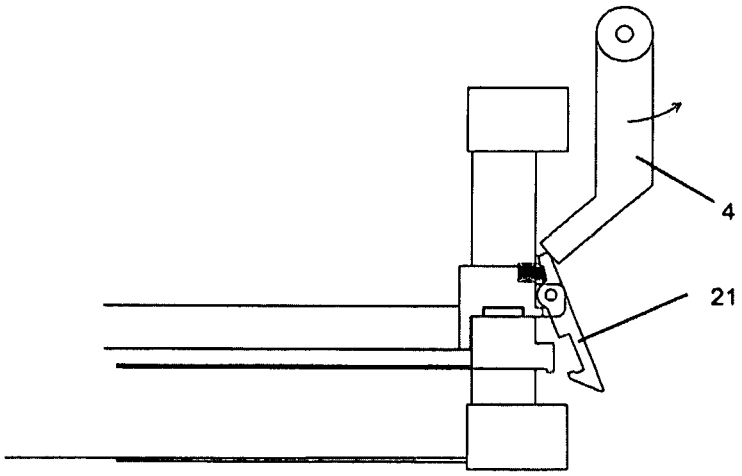
FIG. 25 is a schematic view showing the process of disconnecting a crook locking plate from a hoist bracket comprising a swingable part of the present invention.

FIGS. 24 and 25 are schematic views showing the cooperation of the hoist bracket, comprising another kind of unlock piece, with the crook locking plate 21. Unlike the above two embodiments, the unlock piece of the present embodiment is a swingable part 4 which may be provided on the hoist bracket by means of a member, such as a pivot shaft, and which is rotatable around the pivot shaft (the pivot shaft).

The swingable part 4 may swing from the location shown in FIG. 24 to the location shown in FIG. 25 where it is possible to contact with the second end of the crook locking plate 21, applies a force to the second end of the crook locking plate 21, thus the crook locking plate 21 is caused to disengage from the crook lug 23. The swingable part 4 may be configured to have a bend so that the contact with the crook locking plate 21 is further facilitated. In addition, the swing of the swingable part 4 may escape from the corner piece 121 so that the swingable part 4 is unlikely to occur undesirable interference with the corner piece 121. As shown in FIG. 25, now the hoist bracket lifts the top cover 12 of the collapsible container, and the swingable part 4 may move away from the crook locking plate 21, as a result, the crook locking plate 21 is caused to return to its original state.

As shown in FIGS. 1 to 4, the present invention also discloses a collapsible container comprising the above connection mechanism.

The present invention has been described with the above embodiments thereof, however, it should be appreciated that the above embodiments are used only for the purpose of illustration and explanation, rather than limiting the present invention within the scope of the described embodiments. Furthermore, the skilled in this art would understand that the present invention is not restricted to the above embodiments; the teaching according to the present invention can also be altered and modified in various ways, all of which fall into the protective scope claimed by the present invention.

What is claimed is:

1. A connecting mechanism for a collapsible container, the collapsible container comprises a top cover and a chassis, four corners of the top cover are provided with a top corner piece which is connected with a top cover corner pillar, and four corners of the chassis are provided with a bottom corner piece which is connected with a chassis corner pillar, characterized in that the connecting mechanism comprises:

a crook lug located at one of the top cover corner pillar and the chassis corner pillar; and a crook locking plate rotatablely provided at the outer end face of the other of the top cover corner pillar and the chassis corner pillar, the first end of the crook locking plate is provided with a crook part cooperating with the crook lug, wherein the connecting mechanism further comprises an elastic element, one end of which abuts against the outer end face of the other of the top cover corner pillar and the chassis corner pillar and the other end of which abuts against the crook locking plate.

2. The connecting mechanism according to claim 1, characterized in that the crook lug extends and protrudes from the outer end face of the one of the top cover corner pillar and the chassis corner pillar.

3. The connecting mechanism according to claim 2, characterized in that the connecting mechanism further comprises a crook locking plate shaft by means of which the crook locking plate is hinged with the other of the top cover corner pillar and the chassis corner pillar.

4. The connecting mechanism according to claim 2, characterized in that at least one of the first end of the crook locking plate and the crook lug is provided with a second guiding inclined plane.

5. The connecting mechanism according to claim 1, characterized in that the crook locking plate is provided with a groove for receiving the elastic element, and the elastic element abuts against the bottom surface of the groove.

6. The connecting mechanism according to claim 1, characterized in that the connecting mechanism further comprises a stopper mechanism detachably connected with the crook locking plate.

7. The connecting mechanism according to claim 6, characterized in that the stopper mechanism is provided at the outer end face of the other of the top cover corner pillar and the chassis corner pillar.

8. The connecting mechanism according to claim 7, characterized in that the stopper mechanism comprises a first stopper and a first stopper shaft, the first end of the first stopper is provided with a hole through which the first stopper shaft passes to be hinged with the other of the top cover corner pillar and the chassis corner pillar, a second end of the first stopper is provided with a stopper crook cooperating with the second end of the crook locking plate.

9. The connecting mechanism according to claim 8, characterized in that at least one of the second end of the crook locking plate and the second end of the first stopper is provided with a first guiding inclined plane.

10. The connecting mechanism according to claim 7, characterized in that the first end of the crook locking plate is provided with an operating panel laterally protruding from the crook locking plate.

11. The connecting mechanism according to claim 6, characterized in that the stopper mechanism is provided at the outer end face of the one of the top cover corner pillar and the chassis corner pillar.

12. The connecting mechanism according to claim 11, characterized in that the stopper mechanism comprises a second stopper and a second stopper shaft, the first end of the second stopper is provided with a hole through which the second stopper shaft passes to be hinged with the one of the top cover corner pillar and the chassis corner pillar, the second stopper cooperates with the crook locking plate.

13. The connecting mechanism according claim 12, characterized in that the connecting mechanism further comprises stop block for restraining the second stopper, and the stop block is provided at the one of the top cover corner pillar and the chassis corner pillar.

14. The connecting mechanism according to claim 12, characterized in that a second end of the second stopper is provided with a handle.

15. The connecting mechanism according to claim 12, characterized in that the first end of the crook locking plate is provided with an operating panel laterally protruding from the crook locking plate, and the operating panel cooperates with the second stopper.

16. The connecting mechanism according to claim 1, characterized in that the crook locking plate is provided at a location in contact with an unlock piece on a hoist bracket of the collapsible container, and when the collapsible container is in a folded state, the unlock piece on the hoist bracket contacts with the crook locking plate to disengage the crook locking plate from the crook lug.

17. A collapsible container, characterized in that it comprises a connecting mechanism for the collapsible container, the collapsible container comprises a top cover and a chassis, four corners of the top cover are provided with a top corner piece which is connected with a top cover corner pillar, and four corners of the chassis are provided with a bottom corner piece which is connected with a chassis corner pillar, characterized in that the connecting mechanism comprises:

a crook lug located at one of the top cover corner pillar and the chassis corner pillar; and a crook locking plate rotatablely provided at the outer end face of the other of the top cover corner pillar and the chassis corner pillar, the first end of the crook locking plate is provided with a crook part cooperating with the crook lug, and wherein the connecting mechanism further comprises an elastic element, one end of which abuts against the outer end face of the other of the top cover corner pillar and the chassis corner pillar and the other end of which abuts against the crook locking plate.

18. The collapsible container according to claim 17, characterized in that it comprises the connecting mechanism that the crook lug extends and protrudes from the outer end face of the one of the top cover corner pillar and the chassis corner pillar.

19. The collapsible container according to claim 18, characterized in that it comprises the connecting mechanism that further comprises a crook locking plate shaft by means of which the crook locking plate is hinged with the other of the top cover corner pillar and the chassis corner pillar.

* * * * *